US007132635B2

(12) United States Patent
Dowling

(10) Patent No.: US 7,132,635 B2
(45) Date of Patent: Nov. 7, 2006

(54) METHODS AND APPARATUS FOR CAMOUFLAGING OBJECTS

(75) Inventor: Kevin J. Dowling, Westford, MA (US)

(73) Assignee: Color Kinetics Incorporated, Boston, MA (US)

( * ) Notice: Subject to any disclaimer, the term of this patent is extended or adjusted under 35 U.S.C. 154(b) by 27 days.

(21) Appl. No.: 10/369,222

(22) Filed: Feb. 19, 2003

(65) Prior Publication Data

US 2004/0036006 A1 Feb. 26, 2004

Related U.S. Application Data

(60) Provisional application No. 60/357,873, filed on Feb. 19, 2002.

(51) Int. Cl.
*G01J 1/32* (2006.01)

(52) U.S. Cl. ..... 250/205; 250/553; 348/122; 472/61

(58) Field of Classification Search ..... 250/205, 250/552, 553, 208.1, 208.2; 348/122, 586; 472/61; 315/297, 312, 317, 318
See application file for complete search history.

(56) References Cited

U.S. PATENT DOCUMENTS 6,150,774 A * 11/2000 Mueller et al. ..... 315/291
6,459,076 B1 * 10/2002 Schlenker ..... 250/205
6,608,453 B1 * 8/2003 Morgan et al. ..... 315/312
6,805,957 B1 * 10/2004 Santos et al. ..... 428/400

* cited by examiner

*Primary Examiner*—Kevin Pyo
(74) *Attorney, Agent, or Firm*—Wolf, Greenfield & Sacks, P.C.

(57) ABSTRACT

Methods and apparatus that employ one or more light sources to reduce the ability to recognize or identify one or more objects. In various examples, one or more LED-based light sources are utilized in camouflaging techniques. The apparatus and methods disclosed relating to camouflaging techniques have wide applicability in a number of environments (and with a number of different objects) including, but not limited to, military, commercial, industrial, sporting, recreational, and entertainment applications.

40 Claims, 5 Drawing Sheets

METHODS AND APPARATUS FOR CAMOUFLAGING OBJECTS

CROSS-REFERENCES TO RELATED APPLICATIONS

This application claims the benefit, under 35 U.S.C. §119(e), of U.S. Provisional Application Ser. No. 60/357,873, filed Feb. 19, 2002, and entitled "Systems and Methods for Camouflaging Objects."

FIELD OF THE INVENTION

The present invention relates generally to reducing the ability to recognize or identify a variety of objects by employing one or more light sources and, more particularly, to various camouflaging techniques utilizing one or more LED-based light sources.

BACKGROUND

Camouflage is necessary for deception and is often used by both animals and humans for disguise and protection. Camouflage techniques for the military have been pursued for well over a century but have primarily taken the form of surface colors and textures chosen for the particular milieu. In addition to personnel and land-based forces using these techniques, naval and aviation applications have been used since WWI. Coatings have ranged from neutral colors to razzle-dazzle schemes that break up the outline of large surfaces making it difficult to see the shape of the object. A variety of coloring schemes have been used aboard aircraft for years to provide delay of observation during daylight sorties. The Compass Ghost program during the Vietnam War is one such example.

Beginning in WWII however, a new technique was developed that is now generally termed active camouflage. The addition of energized lighting or display surfaces has been tested but rarely deployed even though shown to be successful in principle. This has the benefit of making the object not appearing to simply be a shadow. Through the use of surface illumination, an object can be made to substantially integrate with its surroundings, making it difficult to see with the eye.

During WWII, The US Navy's Project Yehudi used lights mounted on the leading edges of the wings of a torpedo bomber to successfully hide the plane in broad daylight when attacking a submarine. Visual detection range in the tests dropped substantially from 12 to 2 miles. As the plane approached a target, the lights, which pointed forward, were coupled with a photocell such that the output intensity (not color) of the light was set to match the intensity of the sky behind the approaching plane. This effect takes advantage of a physiological phenomenon termed isoluminance where objects of similar intensity can be indistinguishable from one another under certain conditions.

Yehudi, kept secret for many years, was never used because the advent of airborne radar systems in WWII rendered it moot. During the Vietnam War, however, a program called Compass Ghost revived advanced paint schemes and an attempt to try the Yehudi technique again on an F-4 Phantom. More recently in the mid 1990's were reports of a Project Ivy done by the Air Force that considered or used color panels.

The rapid development and deployment of radar systems combined with the end of the war eliminated the need for such techniques. The electromagnetic techniques of radio ranging through radar meant that eyes were trained upon radar displays and not the sky, and made pointless the need for such developments.

In the 1970s and 80's though, new developments in stealth aircraft rendered these aviation developments invisible to radar systems. Strikingly, although the stealth aircraft are nearly invisible to radar, they operate only at night because they are among the most visible of aircraft during the day.

SUMMARY

In view of the foregoing, the Applicant has recognized and appreciated that alternative and effective techniques for providing active camouflaging would have significant applicability in military and other applications. Accordingly, the present invention relates generally to methods and apparatus that employ one or more light sources to reduce the ability to recognize or identify a variety of objects. In various embodiments, one or more LED-based light sources are utilized in various camouflaging techniques.

For example, one embodiment of the present invention is directed to a method for camouflaging at least one object. The method comprises an act of generating radiation from at least one LED-based light source associated with the at least one object so as to reduce an ability to recognize or identify the at least one object.

Another embodiment of the invention is directed to an apparatus, comprising at least one object, and at least one LED-based light source associated with the at least one object and configured to generate radiation so as to reduce an ability to recognize or identify the at least one object.

Another embodiment of the present invention is directed to a lighting system for camouflaging at least one object. The lighting system comprises a first addressable lighting unit including at least one first LED-based light source, at least one second addressable lighting unit including at least one second LED-based light source, and at least one sensor configured to monitor at least one detectable condition associated with the at least one object. The system also comprise at least one controller coupled to the first addressable lighting unit, the at least one second addressable lighting unit, and the at least one sensor, wherein the at least one controller is configured to process information acquired by the at least one sensor regarding the at least one detectable condition and dynamically control the first addressable lighting unit and the at least one second addressable lighting unit via addressed data so as to generate radiation having at least one characteristic that facilitates camouflaging the at least one object.

It should be appreciated the all combinations of the foregoing concepts and additional concepts discussed in greater detail below are contemplated as being part of the inventive subject matter disclosed herein. In particular, all combinations of claimed subject matter appearing at the end of this disclosure are contemplated as being part of the inventive subject matter.

As used herein for purposes of the present disclosure, the term "LED" should be understood to include any light emitting diode or other type of carrier injection/junction-based system that is capable of generating radiation in response to an electric signal. Thus, the term LED includes, but is not limited to, various semiconductor-based structures that emit light in response to current, light emitting polymers, light-emitting strips, electro-luminescent strips, and the like.

In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured to generate radiation having various bandwidths for a given spectrum (e.g., narrow bandwidth, broad bandwidth).

For example, one implementation of an LED configured to generate essentially white light (e.g., a white LED) may include a number of dies which respectively emit different spectrums of luminescence that, in combination, mix to form essentially white light. In another implementation, a white light LED may be associated with a phosphor is material that converts luminescence having a first spectrum to a different second spectrum. In one example of this implementation, luminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectrums of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources as defined above, incandescent sources (e.g., filament lamps, halogen lamps), fluorescent sources, phosphorescent sources, high-intensity discharge sources (e.g., sodium vapor, mercury vapor, and metal halide lamps), lasers, other types of luminescent sources, electro-lumiscent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication and/or illumination. An "illumination source" is a light source that is particularly configured to generate radiation having a sufficient intensity to effectively illuminate an interior or exterior space.

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (essentially few frequency or wavelength components) or a relatively wide bandwidth (several frequency or wavelength components having various relative strengths). It should also be appreciated that a given spectrum may be the result of a mixing of two or more other spectrums (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to different spectrums having different wavelength components and/or bandwidths. It also should be appreciated that the term "color" may be used in connection with both white and non-white light.

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in degrees Kelvin (K) of a black body radiator that radiates essentially the same spectrum as the radiation sample in question. The color temperature of white light generally falls within a range of from approximately 700 degrees K (generally considered the first visible to the human eye) to over 10,000 degrees K.

Lower color temperatures generally indicate white light having a more significant red component or a "warmer feel," while higher color temperatures generally indicate white light having a more significant blue component or a "cooler feel." By way of example, a wood burning fire has a color temperature of approximately 1,800 degrees K, a conventional incandescent bulb has a color temperature of approximately 2848 degrees K, early morning daylight has a color temperature of approximately 3,000 degrees K, and overcast midday skies have a color temperature of approximately 10,000 degrees K. A color image viewed under white light having a color temperature of approximately 3,000 degree K has a relatively reddish tone, whereas the same color image viewed under white light having a color temperature of approximately 10,000 degrees K has a relatively bluish tone.

The terms "lighting unit" and "lighting fixture" are used interchangeably herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources.

The terms "processor" or "controller" are used herein interchangeably to describe various apparatus relating to the operation of one or more light sources. A processor or controller can be implemented in numerous ways, such as with dedicated hardware, using one or more microprocessors that are programmed using software (e.g., microcode or firmware) to perform the various functions discussed herein, or as a combination of dedicated hardware to perform some functions and programmed microprocessors and associated circuitry-to perform other functions.

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers, including by retrieval of stored sequences of instructions.

The term "addressable" is used herein to refer to a device (e.g., a light source in general, a lighting unit or fixture, a controller or processor associated with one or more light sources or lighting units, other non-lighting related devices, etc.) that is configured to receive information (e.g., data) intended for multiple devices, including itself, and to selectively respond to particular information intended for it. The term "addressable" often is used in connection with a networked environment (or a "network," discussed further below), in which multiple devices are coupled together via some communications medium or media.

In one implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present invention, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

The term "user interface" as used herein refers to an interface between a human user or operator and one or more devices that enables communication between the user and the device(s). Examples of user interfaces that may be employed in various implementations of the present invention include, but are not limited to, switches, human-machine interfaces, operator interfaces, potentiometers, buttons, dials, sliders, a mouse, keyboard, keypad, various types of game controllers (e.g., joysticks), track balls, display screens, various types of graphical user interfaces (GUIs), touch screens, microphones and other types of sensors that may receive some form of human-generated stimulus and generate a signal in response thereto.

The following patents and patent applications are hereby incorporated herein by reference:

U.S. Pat. No. 6,016,038, issued Jan. 18, 2000, entitled "Multicolored LED Lighting Method and Apparatus;"

U.S. Pat. No. 6,211,626, issued Apr. 3, 2001 to Lys et al, entitled "Illumination Components;"

U.S. patent application Ser. No. 09/870,193, filed May 30, 2001, entitled "Methods and Apparatus for Controlling Devices in a Networked Lighting System;"

U.S. patent application Ser. No. 09/344,699, filed Jun. 25, 1999, entitled "Method for Software Driven Generation of Multiple Simultaneous High Speed Pulse Width Modulated Signals;"

U.S. patent application Ser. No. 09/805,368, filed Mar. 13, 2001, entitled "Light-Emitting Diode Based Products;"

U.S. patent application Ser. No. 09/663,969, filed Sep. 19, 2000, entitled "Universal Lighting Network Methods and Systems;"

U.S. patent application Ser. No. 09/716,819, filed Nov. 20, 2000, entitled "Systems and Methods for Generating and Modulating Illumination Conditions;"

U.S. patent application Ser. No. 09/675,419, filed Sep. 29, 2000, entitled "Systems and Methods for Calibrating Light Output by Light-Emitting Diodes;"

U.S. patent application Ser. No. 09/870,418, filed May 30, 2001, entitled "A Method and Apparatus for Authoring and Playing Back Lighting Sequences;"

U.S. patent application Ser. No. 10/045,629, filed Oct. 25, 2001, entitled "Methods and Apparatus for Controlling Illumination;"

U.S. patent application Ser. No. 10/245,786, filed Sep. 17, 2002, entitled "Light Emitting Diode Based Products";

U.S. patent application Ser. No. 10/245,788, filed Sep. 17, 2002, entitled "Methods and Apparatus for Generating and Modulating White Light Illumination Conditions;"

U.S. patent application Ser. No. 10/158,579, filed May 30, 2002, entitled "Methods and Apparatus for Controlling Devices in a Networked Lighting System;" and U.S. Patent Application Ser. No. 60/401,965, filed Aug. 8, 2002, entitled "Methods and Apparatus for Controlling Addressable Systems."

DETAILED DESCRIPTION

Various embodiments of the present invention are described below, including certain embodiments relating particularly to LED-based light sources. It should be appreciated, however, that the present invention is not limited to any particular manner of implementation, and that the various embodiments discussed explicitly herein are primarily for purposes of illustration. For example, the various concepts discussed herein may be suitably implemented in a variety of environments involving LED-based light sources, other types of light sources not including LEDs, environments that involve both LEDs and other types of light sources in combination, and environments that involve non-lighting-related devices alone or in combination with various types of light sources.

As discussed above, the present invention relates generally to methods and apparatus that employ one or more light sources to reduce an ability to recognize or identify one or more objects. In various embodiments, one or more LED-based light sources are utilized in camouflaging techniques. The apparatus and methods disclosed herein relating to camouflaging techniques have wide applicability in a number of environments (and with a number of different objects) including, but not limited to, military applications, commercial applications, industrial applications, sporting and other recreational applications, entertainment applications, etc.

One embodiment of the present invention relates particularly to using one or more LED-based light sources, or LED-based lighting systems, to illuminate one or more objects in such a way as to facilitate camouflaging the object(s). Accordingly, such light sources and lighting systems are discussed first below, followed by a discussion of various methods and apparatus employing such light sources and systems.

Figure 1:
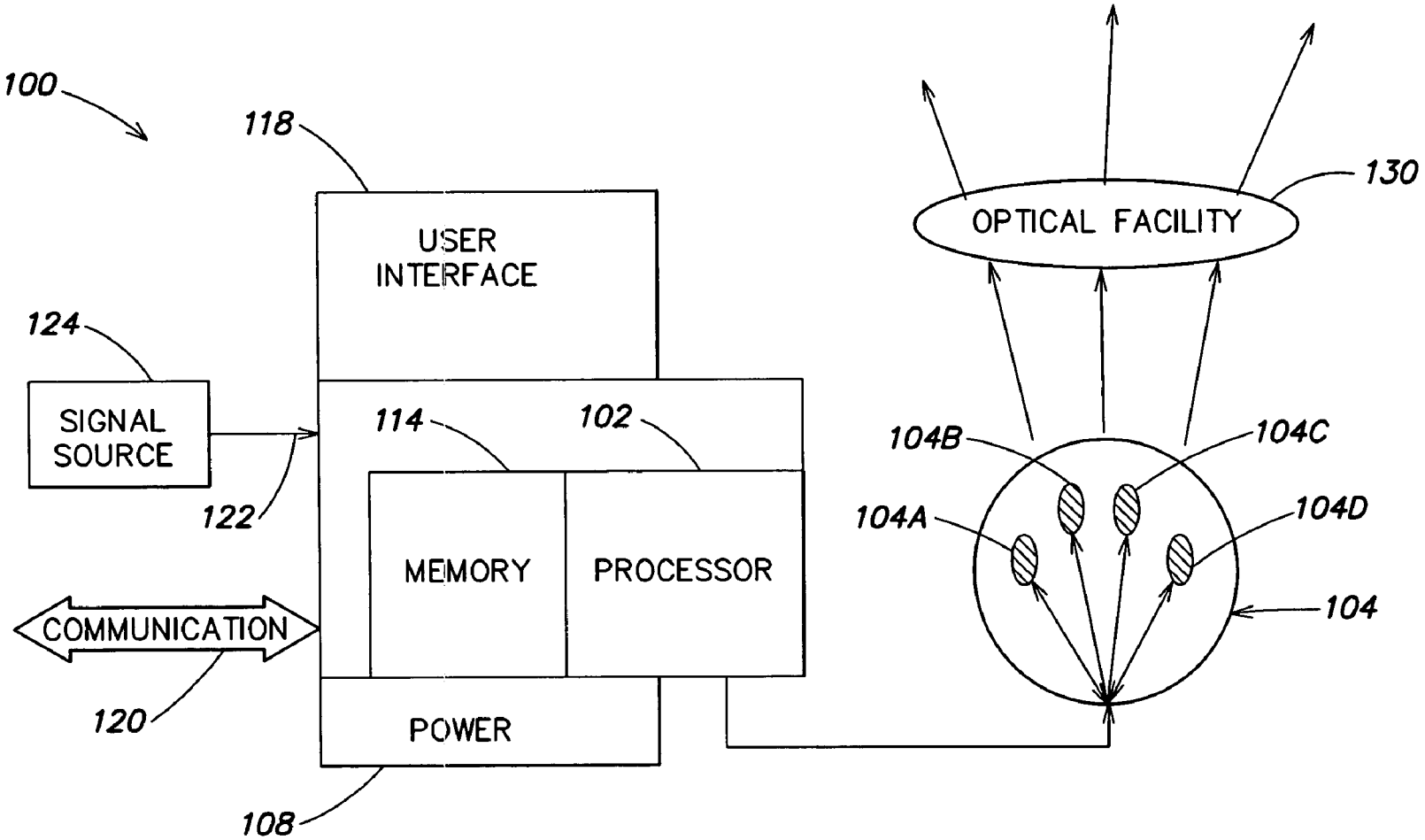
FIG. 1 is a diagram illustrating a lighting unit according to one embodiment of the invention.

FIG. 1 illustrates one example of a lighting unit 100 that may serve as a device in a method or apparatus for camouflaging one or more objects, according to one embodiment of the present invention. Some examples of LED-based lighting units similar to those that are described below in connection with FIG. 1 may be found, for example, in U.S. Pat. No. 6,016,038, issued Jan. 18, 2000 to Mueller et al., entitled "Multicolored LED Lighting Method and Apparatus," and U.S. Pat. No. 6,211,626, issued Apr. 3, 2001 to Lys et al, entitled "Illumination Components," which patents are both hereby incorporated herein by reference. In various embodiments of the present invention, the lighting unit 100 shown in FIG. 1 may be used alone or together with other similar lighting units in a system of lighting units (e.g., as discussed further below in connection with FIG. 2).

In one embodiment, the lighting unit 100 shown in FIG. 1 may include one or more light sources 104A, 104B, 104C, and 104D (indicated collectively as 104) wherein one or more of the light sources may be an LED-based light source that includes one or more light emitting diodes (LEDs). In one aspect of this embodiment, any two or more of the light sources 104A, 104B, 104C and 104D may be adapted to generate radiation of different colors (e.g. red, green, and blue, respectively). Although FIG. 1 shows four light sources 104A, 104B, 104C, and 104D, it should be appreciated that the lighting unit is not limited in this respect, as different numbers and various types of light sources (all LED-based light sources, LED-based and non-LED-based light sources in combination, etc.) adapted to generate radiation of a variety of different colors, including essentially white light, may be employed in the lighting unit 100, as discussed further below.

As shown in FIG. 1, the lighting unit 100 also may include a processor 102 that is configured to output one or more control signals to drive the light sources 104A, 104B, 104C and 104D so as to generate various intensities of light from the light sources. For example, in one implementation, the processor 102 may be configured to output at least one control signal for each light source so as to independently control the intensity of light generated by each light source. Some examples of control signals that may be generated by the processor to control the light sources include, but are not limited to, pulse modulated signals, pulse width modulated signals (PWM), pulse amplitude modulated signals (PAM), pulse code modulated signals (PCM), pulse displacement modulated signals, analog control signals (e.g., current control signals, voltage control signals), combinations and/or modulations of the foregoing signals, or other control signals. In one aspect, the processor 102 may control other dedicated circuitry (not shown in FIG. 1), which in turn controls the light sources so as to vary their respective intensities.

In one embodiment of the lighting unit 100, one or more of the light sources 104A, 104B, 104C and 104D shown in FIG. 1 may include a group of multiple LEDs or other types of light sources (e.g., various parallel and/or serial connections of LEDs or other types of light sources) that are controlled together by the processor 102. Additionally, it should be appreciated that one or more of the light sources 104A, 104B, 104C and 104D may include one or more LEDs that are adapted to generate radiation having any of a variety of spectra (i.e., wavelengths or wavelength bands), including, but not limited to, various visible colors (including essentially white light), various color temperatures of white light, ultraviolet, or infrared. LEDs having a variety of spectral bandwidths (e.g., narrow band, broader band) may be employed in various implementations of the lighting unit 100.

In another aspect of the lighting unit 100 shown in FIG. 1, the lighting unit 100 may be constructed and arranged to produce a wide range of variable color radiation. For example, the lighting unit 100 may be particularly arranged such that the processor-controlled variable intensity light generated by two or more of the light sources combines to produce a mixed colored light (including essentially white light having a variety of color temperatures). In particular, the color (or color temperature) of the mixed colored light may be varied by varying one or more of the respective intensities of the light sources (e.g., in response to one or more control signals output by the processor 102). Furthermore, the processor 102 may be particularly configured (e.g., programmed) to provide control signals to one or more of the light sources so as to generate a variety of static or time-varying (dynamic) multi-color (or multi-color temperature) lighting effects.

Thus, the lighting unit 100 may include a wide variety of colors of LEDs in various combinations, including two or more of red, green, and blue LEDs to produce a color mix, as well as one or more other LEDs to create varying colors and color temperatures of white light. For example, red, green and blue can be mixed with amber, white, UV, orange, IR or other colors of LEDs. Such combinations of differently colored LEDs in the lighting unit 100 can facilitate accurate reproduction of a host of desirable spectrums of lighting conditions, examples of which includes, but are not limited to, a variety of outside daylight equivalents at different times of the day, various interior lighting conditions, lighting conditions to simulate a complex multicolored background, and the like. Other desirable lighting conditions can be created by removing particular pieces of spectrum that may be specifically absorbed, attenuated or reflected in certain environments. Water, for example tends to absorb and attenuate most non-blue and non-green colors of light, so underwater applications may benefit from lighting conditions that are tailored to emphasize or attenuate some spectral elements relative to others.

As shown in FIG. 1, the lighting unit 100 also may include a memory 114 to store various information. For example, the memory 114 may be employed to store one or more lighting programs for execution by the processor 102 (e.g., to generate one or more control signals for the light sources), as well as various types of data useful for generating variable color radiation (e.g., calibration information, discussed further below). The memory 114 also may store one or more particular identifiers (e.g., a serial number, an address, etc.) that may be used either locally or on a system level to identify the lighting unit 100. In various embodiments, such identifiers may be pre-programmed by a manufacturer, for example, and may be either alterable or non-alterable thereafter (e.g., via some type of user interface located on the lighting unit, via one or more data or control signals received by the lighting unit, etc.). Alternatively, such identifiers may be determined at the time of initial use of the lighting unit in the field, and again may be alterable or non-alterable thereafter.

One issue that may arise in connection with controlling multiple light sources in the lighting unit 100 of FIG. 1, and controlling multiple lighting units 100 in a lighting system (e.g., as discussed below in connection with FIG. 2), relates to potentially perceptible differences in light output between substantially similar light sources. For example, given two virtually identical light sources being driven by respective identical control signals, the actual intensity of light output by each light source may be perceptibly different. Such a difference in light output may be attributed to various factors including, for example, slight manufacturing differences between the light sources, normal wear and tear over time of the light sources that may differently alter the respective spectrums of the generated radiation, etc. For purposes of the present discussion, light sources for which a particular relationship between a control signal and resulting intensity are not known are referred to as "uncalibrated" light sources.

The use of one or more uncalibrated light sources in the lighting unit 100 shown in FIG. 1 may result in generation of light having an unpredictable, or "uncalibrated," color or color temperature. For example, consider a first lighting unit including a first uncalibrated red light source and a first uncalibrated blue light source, each controlled by a corresponding control signal having an adjustable parameter in a range of from zero to 255 (0–255). For purposes of this example, if the red control signal is set to zero, blue light is generated, whereas if the blue control signal is set to zero, red light is generated. However, if both control signals are varied from non-zero values, a variety of perceptibly different colors may be produced (e.g., in this example, at very least, many different shades of purple are possible). In particular, perhaps a particular desired color (e.g., lavender) is given by a red control signal having a value of 125 and a blue control signal having a value of 200.

Now consider a second lighting unit including a second uncalibrated red light source substantially similar to the first uncalibrated red light source of the first lighting unit, and a second uncalibrated blue light source substantially similar to the first uncalibrated blue light source of the first lighting unit. As discussed above, even if both of the uncalibrated red light sources are driven by respective identical control signals, the actual intensity of light output by each red light source may be perceptibly different. Similarly, even if both of the uncalibrated blue light sources are driven by respective identical control signals, the actual intensity of light output by each blue light source may be perceptibly different.

With the foregoing in mind, it should be appreciated that if multiple uncalibrated light sources are used in combination in lighting units to produce a mixed colored light as discussed above, the observed color (or color temperature) of light produced by different lighting units under identical control conditions may be perceivably different. Specifically, consider again the "lavender" example above; the "first lavender" produced by the first lighting unit with a red control signal of 125 and a blue control signal of 200 indeed may be perceptibly different than a "second lavender" produced by the second lighting unit with a red control signal of 125 and a blue control signal of 200. More generally, the first and second lighting units generate uncalibrated colors by virtue of their uncalibrated light sources.

In view of the foregoing, in one embodiment of the present invention, the lighting unit 100 includes calibration means to facilitate the generation of light having a calibrated (e.g., predictable, reproducible) color at any given time. In one aspect, the calibration means is configured to adjust the light output of at least some light sources of the lighting unit so as to compensate for perceptible differences between similar light sources used in different lighting units.

For example, in one embodiment, the processor 102 of the lighting unit 100 is configured to control one or more of the light sources 104A, 104B, 104C and 104D so as to output radiation at a calibrated intensity that substantially corresponds in a predetermined manner to a control signal for the light source(s). As a result of mixing radiation having different spectra and respective calibrated intensities, a calibrated color is produced. In one aspect of this embodiment, at least one calibration value for each light source is stored in the memory 114, and the processor is programmed to apply the respective calibration values to the control signals for the corresponding light sources so as to generate the calibrated intensities.

In one aspect of this embodiment, one or more calibration values may be determined once (e.g., during a lighting unit manufacturing/testing phase) and stored in the memory 114 for use by the processor 102. In another aspect, the processor 102 may be configured to derive one or more calibration values dynamically (e.g. from time to time) with the aid of one or more photosensors, for example. In various embodiments, the photosensor(s) may be one or more external components coupled to the lighting unit, or alternatively may be integrated as part of the lighting unit itself. A photosensor is one example of a signal source that may be integrated or otherwise associated with the lighting unit 100, and monitored by the processor 102 in connection with the operation of the lighting unit. Other examples of such signal sources are discussed further below, in connection with the signal source 124 shown in FIG. 1.

One exemplary method that may be implemented by the processor 102 to derive one or more calibration values includes applying a reference control signal to a light source, and measuring (e.g., via one or more photosensors) an intensity of radiation thus generated by the light source. The processor may be programmed to then make a comparison of the measured intensity and at least one reference value (e.g., representing an intensity that nominally would be expected in response to the reference control signal). Based on such a comparison, the processor may determine one or more calibration values for the light source. In particular, the processor may derive a calibration value such that, when applied to the reference control signal, the light source outputs radiation having an intensity that corresponds to the reference value (i.e., the "expected" intensity).

In various aspects, one calibration value may be derived for an entire range of control signal/output intensities for a given light source. Alternatively, multiple calibration values may be derived for a given light source (i.e., a number of calibration value "samples" may be obtained) that are respectively applied over different control signal/output intensity ranges, to approximate a nonlinear calibration function in a piecewise linear manner.

In another aspect, as also shown in FIG. 1, the lighting unit 100 optionally may include one or more user interfaces 118 that are provided to facilitate any of a number of user-selectable settings or functions (e.g., generally controlling the light output of the lighting unit 100, changing and/or selecting various pre-programmed lighting effects to be generated by the lighting unit, changing and/or selecting various parameters of selected lighting effects, setting particular identifiers such as addresses or serial numbers for the lighting unit, etc.). In various embodiments, the communication between the user interface 118 and the lighting unit may be accomplished through wire or cable, or wireless transmission.

In one implementation, the processor 102 of the lighting unit monitors the user interface 118 and controls one or more of the light sources 104A, 104B, 104C and 104D based at least in part on a user's operation of the interface. For example, the processor 102 may be configured to respond to operation of the user interface by originating one or more control signals for controlling one or more of the light sources. Alternatively, the processor 102 may be configured to respond by selecting one or more pre-programmed control signals stored in memory, modifying control signals generated by executing a lighting program, selecting and executing a new lighting program from memory, or otherwise affecting the radiation generated by one or more of the light sources.

In particular, in one implementation, the user interface 118 may constitute one or more switches (e.g., a standard wall switch) that interrupt power to the processor 102. In one aspect of this implementation, the processor 102 is configured to monitor the power as controlled by the user interface, and in turn control one or more of the light sources 104A, 104B, 104C and 104D based at least in part on a duration of a power interruption caused by operation of the user interface. As discussed above, the processor may be particularly configured to respond to a predetermined duration of a power interruption by, for example, selecting one or more pre-programmed control signals stored in memory, modifying control signals generated by executing a lighting program, selecting and executing a new lighting program from memory, or otherwise affecting the radiation generated by one or more of the light sources.

FIG. 1 also illustrates that the lighting unit 100 may be configured to receive one or more signals 122 from one or more other signal sources 124. In one implementation, the processor 102 of the lighting unit may use the signal(s) 122, either alone or in combination with other control signals (e.g., signals generated by executing a lighting program, one or more outputs from a user interface, etc.), so as to control one or more of the light sources 104A, 104B, 104C and 104D in a manner similar to that discussed above in connection with the user interface.

Examples of the signal(s) 122 that may be received and processed by the processor 102 include, but are not limited to, one or more audio signals, video signals, power signals, various types of data signals, signals representing information obtained from a network (e.g., the Internet), signals representing one or more detectable/sensed conditions, signals from lighting units, signals consisting of modulated light, etc. In various implementations, the signal source(s) 124 may be located remotely from the lighting unit 100, or included as a component of the lighting unit. For example, in one embodiment, a signal from one lighting unit 100 could be sent over a network to another lighting unit 100.

Some examples of a signal source 124 that may be employed in, or used in connection with, the lighting unit 100 of FIG. 1 include any of a variety of sensors or transducers that generate one or more signals 122 in response to some stimulus. Examples of such sensors include, but are not limited to, various types of environmental condition sensors, such as thermally sensitive (e.g., temperature, infrared) sensors, humidity sensors, motion sensors, photosensors/light sensors (e.g., sensors that are sensitive to one or more particular spectra of electromagnetic radiation), various types of cameras, sound or vibration sensors or other pressure/force transducers (e.g., microphones, piezoelectric devices), and the like.

Additional examples of a signal source 124 include various metering/detection devices that monitor electrical signals or characteristics (e.g., voltage, current, power, resistance, capacitance, inductance, etc.) or chemical/biological characteristics (e.g., acidity, a presence of one or more particular chemical or biological agents, bacteria, etc.) and provide one or more signals 122 based on measured values of the signals or characteristics. Yet other examples of a signal source 124 include various types of scanners, image recognition systems, voice or other sound recognition systems, artificial intelligence and robotics systems, and the like. A signal source 124 could also be a lighting unit 100, a processor 102, or any one of many available signal generating devices, such as media players, MP3 players, computers, DVD players, CD players, television signal sources, camera signal sources, microphones, speakers, telephones, cellular phones, instant messenger devices, SMS devices, wireless devices, personal organizer devices, and many others.

In one embodiment, the lighting unit 100 shown in FIG. 1 also may include one or more optical facilities 130 to optically process the radiation generated by the light sources 104A, 104B, 104C and 104D. For example, one or more optical facilities may be configured so as to change one or both of a spatial distribution and a propagation direction of the generated radiation. In particular, one or more optical facilities may be configured to change a diffusion angle of the generated radiation. In one aspect of this embodiment, one or more optical facilities 130 may be particularly configured to variably change one or both of a spatial distribution and a propagation direction of the generated radiation (e.g., in response to some electrical and/or mechanical stimulus). Examples of optical facilities that may be included in the lighting unit 100 include, but are not limited to, reflective materials, refractive materials, translucent materials, filters, lenses, mirrors, and fiber optics. The optical facility 130 also may include a phosphorescent material, luminescent material, or other material capable of responding to or interacting with the generated radiation.

As also shown in FIG. 1, the lighting unit 100 may include one or more communication ports 120 to facilitate coupling of the lighting unit 100 to any of a variety of other devices. For example, one or more communication ports 120 may facilitate coupling multiple lighting units together as a networked lighting system, in which at least some of the lighting units are addressable (e.g., have particular identifiers or addresses) and are responsive to particular data transported across the network.

In particular, in a networked lighting system environment, as discussed in greater detail further below (e.g., in connection with FIG. 2), as data is communicated via the network, the processor 102 of each lighting unit coupled to the network may be configured to be responsive to particular data (e.g., lighting control commands) that pertain to it (e.g., in some cases, as dictated by the respective identifiers of the networked lighting units). Once a given processor identifies particular data intended for it, it may read the data and, for example, change the lighting conditions produced by its light sources according to the received data (e.g., by generating appropriate control signals to the light sources). In one aspect, the memory 114 of each lighting unit coupled to the network may be loaded, for example, with a table of lighting control signals that correspond with data the processor 102 receives. Once the processor 102 receives data from the network, the processor may consult the table to select the control signals that correspond to the received data, and control the light sources of the lighting unit accordingly.

In one aspect of this embodiment, the processor 102 of a given lighting unit, whether or not coupled to a network, may be configured to interpret lighting instructions/data that are received in a DMX protocol (as discussed, for example, in U.S. Pat. Nos. 6,016,038 and 6,211,626), which is a lighting command protocol conventionally employed in the lighting industry for some programmable lighting applications. However, it should be appreciated that lighting units suitable for purposes of the present invention are not limited in this respect, as lighting units according to various embodiments may be configured to be responsive to other types of communication protocols so as to control their respective light sources.

In one embodiment, the lighting unit 100 of FIG. 1 may include and/or be coupled to one or more power sources 108. In various aspects, examples of power source(s) 108 include, but are not limited to, AC power sources, DC power sources, batteries, solar-based power sources, thermoelectric or mechanical-based power sources and the like. Additionally, in one aspect, the power source(s) 108 may include or be associated with one or more power conversion devices that convert power received by an external power source to a form suitable for operation of the lighting unit 100.

While not shown explicitly in FIG. 1, the lighting unit 100 may be implemented in any one of several different structural configurations according to various embodiments of the present invention. Examples of such configurations include, but are not limited to, an essentially linear or curvilinear configuration, a circular configuration, an oval configuration, a rectangular configuration, combinations of the foregoing, various other geometrically shaped configurations, various two or three dimensional configurations, and the like.

A given lighting unit also may have any one of a variety of mounting arrangements for the light source(s), enclosure/housing arrangements and shapes to partially or fully enclose the light sources, and/or electrical and mechanical connection configurations. In particular, a lighting unit may be configured as a replacement or "retrofit" to engage electrically and mechanically in a conventional socket or fixture arrangement (e.g., an Edison-type screw socket, a halogen fixture arrangement, a fluorescent fixture arrangement, etc.).

Additionally, one or more optical facilities as discussed above may be partially or fully integrated with an enclosure/housing arrangement for the lighting unit. Furthermore, a given lighting unit optionally may be associated with (e.g., include, be coupled to and/or packaged together with) various other components (e.g., control circuitry such as the processor and/or memory, one or more sensors/transducers/signal sources, user interfaces, displays, power sources, power conversion devices, etc.) relating to the operation of the light source(s).

Figure 2:
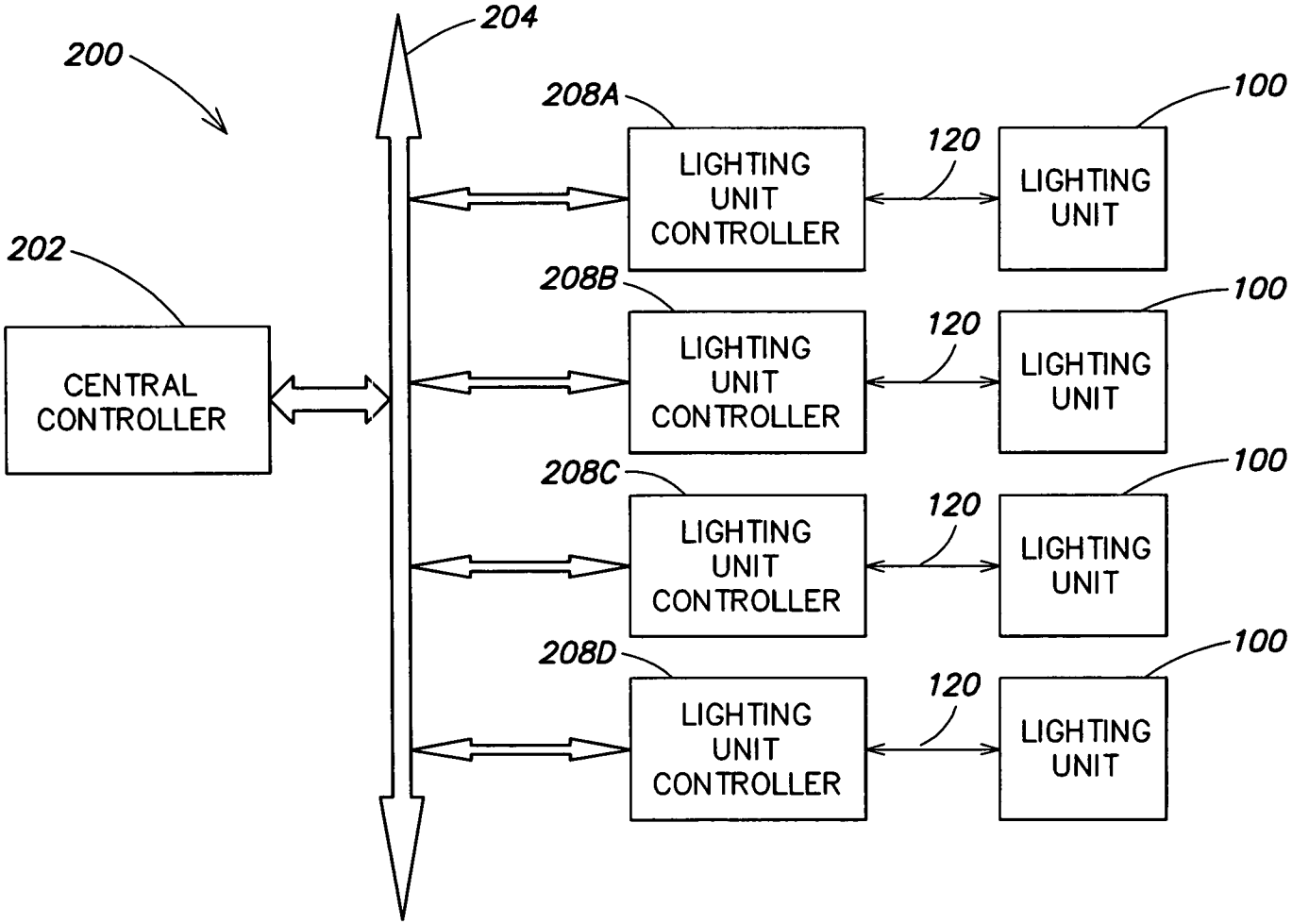
FIG. 2 is a diagram illustrating a plurality of lighting units coupled together to form a networked lighting system, according to one embodiment of the invention.

FIG. 2 illustrates an example of a networked lighting system 200 according to one embodiment of the present invention. In the embodiment of FIG. 2, a number of lighting units 100, similar to those discussed above in connection with FIG. 1, are coupled together to form the networked lighting system. It should be appreciated, however, that the particular configuration and arrangement of lighting units shown in FIG. 2 is for purposes of illustration only, and that the invention is not limited to the particular system topology shown in FIG. 2.

Additionally, while not shown explicitly in FIG. 2, it should be appreciated that the networked lighting system 200 may be configured flexibly to include one or more user interfaces, as well as one or more signal sources such as sensors/transducers. For example, one or more user interfaces and/or one or more signal sources such as sensors/transducers (as discussed above in connection with FIG. 1) may be associated with any one or more of the lighting units of the networked lighting system 200. Alternatively (or in addition to the foregoing), one or more user interfaces and/or one or more signal sources may be implemented as "stand alone" components in the networked lighting system 200. Whether stand alone components or particularly associated with one or more lighting units 100, these devices may be "shared" by the lighting units of the networked lighting system. Stated differently, one or more user interfaces and/or one or more signal sources such as sensors/transducers may constitute "shared resources" in the networked lighting system that may be used in connection with controlling any one or more of the lighting units of the system.

As shown in the embodiment of FIG. 2, the lighting system 200 may include one or more lighting unit controllers (hereinafter "LUCs") 208A, 208B, 208C and 208D, wherein each LUC is responsible for communicating with and generally controlling one or more lighting units 100 coupled to it. Although FIG. 2 illustrates one lighting unit 100 coupled to each LUC, it should be appreciated that the invention is not limited in this respect, as different numbers of lighting units 100 may be coupled to a given LUC in a variety of different configurations (e.g., serial connections, parallel connections, combinations of serial and parallel connections, etc.) using a variety of different communication media and protocols.

In the system of FIG. 2, each LUC in turn may be coupled to a central controller 202 that is configured to communicate with one or more LUCs. Although FIG. 2 shows four LUCs coupled to the central controller 202 via a generic connection 204 (e.g., which may include any number of a variety of conventional coupling, switching and/or networking devices), it should be appreciated that according to various embodiments, different numbers of LUCs may be coupled to the central controller 202. Additionally, according to various embodiments of the present invention, the LUCs and the central controller may be coupled together in a variety of configurations using a variety of different communication media and protocols to form the networked lighting system 200. Moreover, it should be appreciated that the interconnection of LUCs and the central controller, and the interconnection of lighting units to respective LUCs, may be accomplished in different manners (e.g., using different configurations, communication media, and protocols).

For example, according to one embodiment of the present invention, the central controller 202 shown in FIG. 2 may by configured to implement Ethernet-based communications with the LUCs, and in turn the LUCs may be configured to implement DMX-based communications with the lighting units 100. In particular, in one aspect of this embodiment, each LUC may be configured as an addressable Ethernet-based controller and accordingly may be identifiable to the central controller 202 via a particular unique address (or a unique group of addresses) using an Ethernet-based protocol. In this manner, the central controller 202 may be configured to support Ethernet communications throughout the network of coupled LUCs, and each LUC may respond to those communications intended for it. In turn, each LUC may communicate lighting control information to one or more lighting units coupled to it, for example, via a DMX protocol, based on the Ethernet communications with the central controller 202.

More specifically, according to one embodiment, the LUCs 208A, 208B, 208C and 208D shown in FIG. 2 may be configured to be "intelligent" in that the central controller 202 may be configured to communicate higher level commands to the LUCs that need to be interpreted by the LUCs before lighting control information can be forwarded to the lighting units 100. For example, a lighting system operator may want to generate a particular one of several color changing effects that varies colors from lighting unit to lighting unit in such a way as to facilitate camouflaging an object. In this example, the operator may provide a simple instruction to the central controller 202 to accomplish this, and in turn the central controller may communicate to one or more LUCs using an Ethernet-based protocol high-level command to generate the particular camouflaging effect. The command may contain timing, intensity, hue, saturation or other relevant information, for example. When a given LUC receives such a command, it may then interpret the command so as to generate the appropriate lighting control signals which it then communicates using a DMX protocol via any of a variety of signaling techniques (e.g., PWM) to one or more lighting units that it controls.

It should again be appreciated that the foregoing example of using multiple different communication implementations (e.g., Ethernet/DMX) in a lighting system according to one embodiment of the present invention is for purposes of illustration only, and that the invention is not limited to this particular example.

Figure 3:
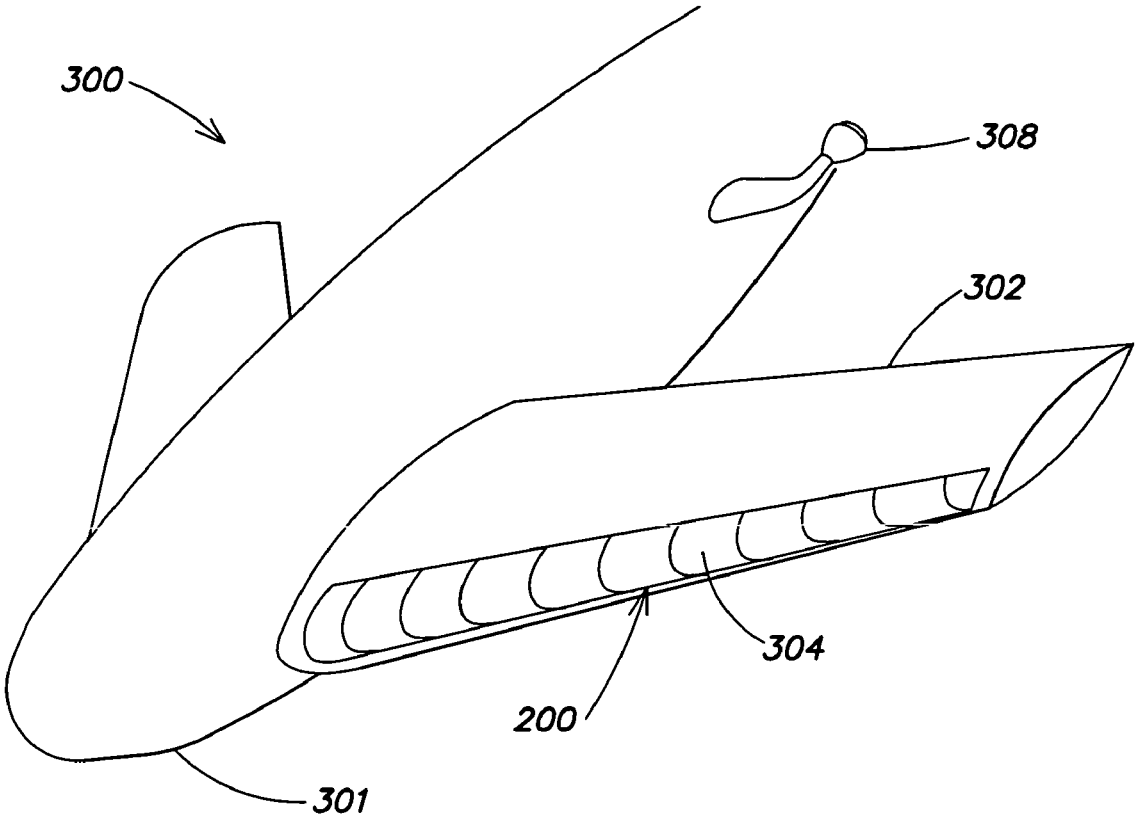
FIG. 3 is a diagram illustrating an exemplary camouflaging technique according to one embodiment of the invention.

FIG. 3 illustrates a camouflaging system 300 used in connection with an aircraft 301, according to one embodiment of the invention. As shown in FIG. 3, the aircraft 301 includes one or more wings 302, one or more optics 304, and one or more sensors 308. One or more lighting systems 200 similar to that illustrated in FIG. 2, including one or is more lighting fixtures 100 (not explicitly shown in FIG. 3) similar to that illustrated in FIG. 1, may be included in one or more portions or sections of the aircraft 301. In one aspect, for example as shown in FIG. 3, one or more lighting systems 200 may be implemented in one or more wings 302 of the aircraft 301. In another aspect, lighting system(s) 200 may be positioned behind one or more optics 304 such that at least some of the radiation emitted by the lighting system irradiates the optic(s).

While the embodiment illustrated in FIG. 3 shows an optic covering a portion of a wing 302, it should be appreciated that one or more optics could cover any portion of the wing or the entire aircraft. Moreover, in other embodiments, one or more optics 304 may not be required, as one or more lighting units of the lighting system may be equipped with optical facilities 130 (as shown in FIG. 1) or other optical elements that are used respectively with each lighting unit of the system or groups of lighting units. One or more optics 304 also may be used in combination with one or more lighting units having optical facilities 130. Alternatively, in yet other embodiments, LED-based lighting units of the lighting system(s) 200 may be viewed directly, without any optics 304 or optical facilities 130.

In another aspect, the camouflaging system 300 of FIG. 3 may include one or more sensors 308 (which may serve as a signal source 124 as discussed above in connection with FIG. 1). Although one sensor 308 is shown in FIG. 3 facing towards a rear portion of the aircraft, it should be appreciated that one or more sensors may be disposed in various locations of the aircraft and facing in various directions. One or more sensors 308 may be configured to monitor the light intensity and/or the color of the environment behind the plane. The information gathered by the sensor(s) may be interpreted by one or more processors (e.g., processors 102 of one or more lighting units, a central controller 202 as shown in FIG. 2, a separate processor dedicated to the task of monitoring the sensor(s) and processing sensor information to facilitate control of one or more lighting systems 200, combinations of the foregoing, etc.). As discussed above in connection with FIG. 1, the sensor(s) 308 may include any of a variety of sensing devices including, but not limited to, cameras, video systems, other types of imaging systems, various environmental sensors, calorimeters, and the like.

In one embodiment, the sensor(s) may measure light intensity, color content, or other parameters of the environment around the aircraft 301. Information provided by the sensor(s) can then be used to control the lighting system(s) 200 (e.g., intensity/color of the light emitted from the lighting system(s)) such that the aircraft blends in with its surroundings. For example, one or more sensors may indicate that the environment behind the plane is relatively cloudless and a generally bright blue color. The sensor information may then be used to control the lighting system such that the lighting system(s) generates a blue color to simulate the surroundings; in particular, the blue color generated by the lighting system(s) may match the environmental surrounding in hue, saturation and or intensity. This will cause the plane to significantly blend in with its surroundings. If, for example, the front and bottom of the aircraft are equipped with lighting systems according to the principles of the present invention, a person located on the ground may look towards the aircraft and not readily observe it.

While the foregoing example involves one or more sensors that monitor color and intensity of light surrounding the aircraft, it should be appreciated that significantly complex image capture systems similarly could be employed to acquire information about the aircraft's surroundings, including clouds, mountains, sunshine, or other environmental conditions. The information gathered from such an image capture system could be used to vary the color of the aircraft via the lighting system(s) 200 to blend it better with these more complex surroundings.

According to another aspect of the invention, one or more sensors may be placed on/around/proximate one or more objects (such as the aircraft 301 in FIG. 3) at particular locations so as to specifically affect lighting produced by one or more lighting units or systems at one or more different particular locations of the object(s). For example, in one embodiment, one or more sensors may be particularly positioned on a portion of an object opposite to that from which lighting produced for camouflaging purposes is to be observed. In this manner, information regarding the surrounding environment of the object(s) (e.g., background lighting information) may be used to generate camouflage lighting from the object(s) (e.g., foreground lighting information) that may render the object(s) virtually invisible to an observer.

Figure 3A:
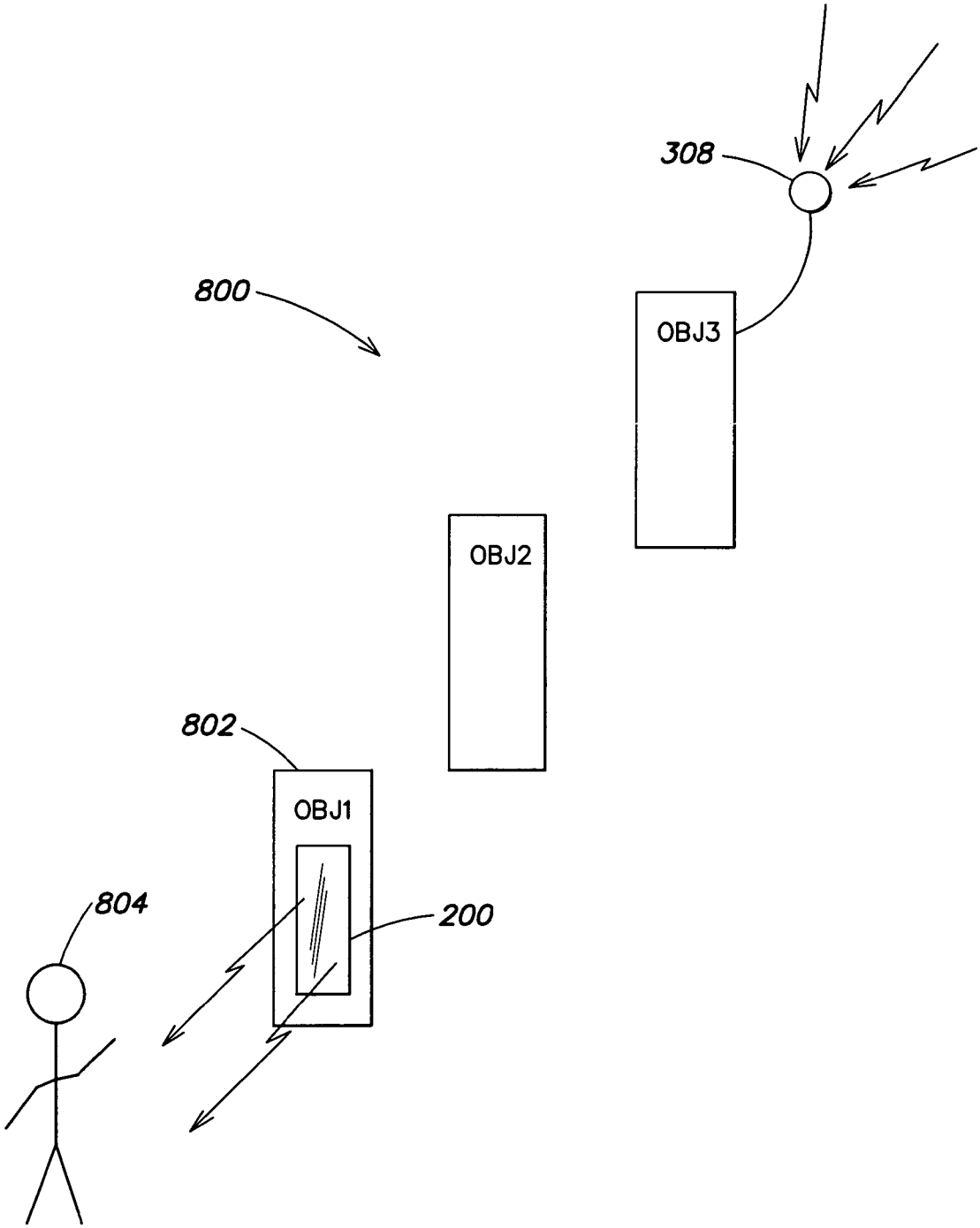
FIG. 3A is a diagram illustrating another exemplary camouflaging technique according to one embodiment of the invention.

It should be readily appreciated that this concept can be extended to camouflaging a set(of multiple objects that may be viewed from one or more particular vantage points. For example, FIG. 3A illustrates a set of objects 800 in a row that may be disguised by utilizing one or more sensors 308 on a "far" side of the objects (opposite to is the viewing side). In FIG. 3A, the sensor 308 measures background lighting information essentially from a direction opposite to that which the objects are to be observed by the observer 804. In this embodiment, all of the objects need not necessarily generate camouflage lighting (e.g., foreground lighting information); alternatively, only one or more objects in the set (e.g., the object 802) may be configured to generate such lighting (e.g., from a lighting system 200), so as to avoid any potentially undesirable illumination artifacts due to propagation of illumination information from object to object and ultimately to the observer 804.

In general, according to one embodiment, multiple differently-colored static or time-varying patterns may be created around different portions of an aircraft or other objects via one or more lighting units 100 or one or more lighting systems 200 associated with the object(s). In one aspect, the color changing capabilities of several such lighting units or systems may be used to effectively generate patterns of light that are configured to simulate various complex surroundings and/or cause a confused image projection. For example, several lighting units/systems may be used to illuminate an object and the lighting effects from the several lighting systems 100 may varied, alternated, coordinated, or otherwise modulated. One of the results of continually changing the lighting effects is that the object may be quite difficult to readily recognize or identify.

Figure 4:
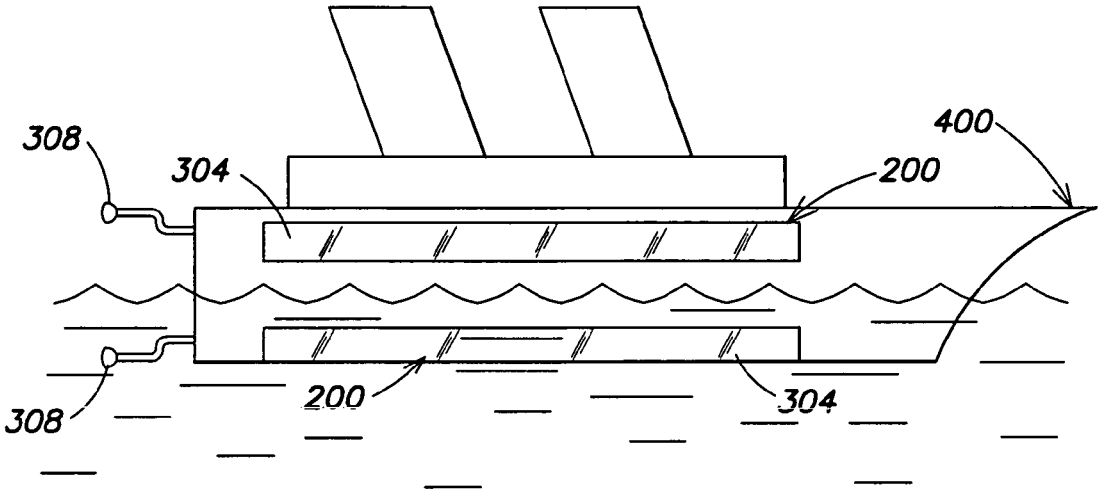
FIG. 4 is a diagram illustrating another exemplary camouflaging technique according to one embodiment of the invention.

FIG. 4 illustrates another embodiment of the present invention. In this embodiment, a boat 400 is equipped with one or more lighting systems 200 which may be used in connection with one or more optics 304, as discussed above in connection with FIG. 3. The lighting system(s) and/or optic(s) may be placed above the water line or below the water line, as indicated in FIG. 4. There may be times that the intended observer is above water and there may be other times that the intended observer is below water. In various examples, employing lighting system(s) 200 for camouflaging different portions of a boat may be employed on commercial, industrial, and recreational water crafts as well as military water crafts; for example, a fishing ship may want to blend in with its surroundings. In this example, one or more sensors 308 may be placed on the boat to face towards the sky and collect lighting data from the sky, and the lighting on the bottom of the boat may be adapted to blend in with the color of the sky as viewed from below the boat. This may be valuable during fishing expeditions so the boat does not appear to be intrusive. In another embodiment, the lighting on the bottom of the boat may be used to contrast the boat against its surroundings such that the boat is very visible from below. This may be useful to attract certain fish. Of course, camouflaging the bottom and/or other portions of the boat may be useful in military applications as well.

Figure 5:
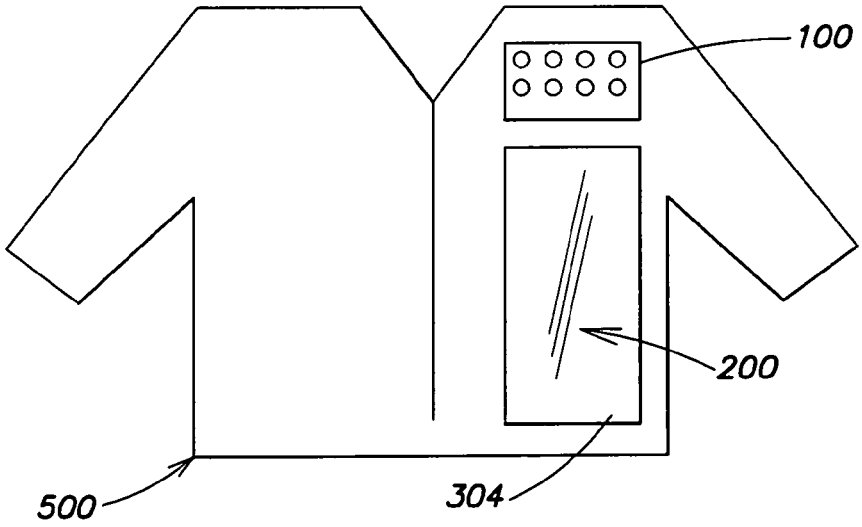
FIG. 5 is a diagram illustrating yet another exemplary camouflaging technique according to one embodiment of the invention.

FIG. 5 illustrates a jacket 500, or other garment, that could be equipped with camouflage lighting according to the present invention. As indicated in FIG. 5, optics 304 may be used as described herein or the lighting units of the lighting system may be viewed directly, with or without optical facilities 130 as discussed above in connection with FIG. 1.

It should be appreciated from the foregoing non-limiting examples that camouflage methods and apparatus according to the principles of the present invention may be used in a host of different applications, including military, commercial, industrial, sporting, recreational, entertainment, and other purposes. A significant number of different object types may be camouflaged according to the present invention, examples of which include, but are not limited to, aircraft, seacraft, land vehicles, weapons, instruments, machinery, tools, various sporting implements, towers, buildings, other outdoor structures (e.g., a cell phone tower or ventilation tower that may be a daytime eyesore), clothing and other garments.

While many of the embodiments described herein show portions of objects that are lit with active camouflaging techniques according to the principles of the present invention, it should be understood that a substantial portion of the object, a portion of the object's surface, a substantial portion of the object's surface, substantially all of the object, and substantially all of the object's surface or other portion of an object may be equipped with such systems.

Having described several embodiments of the invention in detail, various modifications and improvements will readily occur to those skilled in the art. Such modifications and improvements are intended to be within the scope of the invention. While some examples presented herein involve specific combinations of functions or structural elements, it should be understood that those functions and elements may be combined in other ways according to the present invention to accomplish the same or different objectives. In particular, acts, elements and features discussed in connection with one embodiment are not intended to be excluded from a similar role in other embodiments. Accordingly, the foregoing description is by way of example only, and is not intended as limiting.

The invention claimed is:

1. A method for camouflaging at least one object, the method comprising an act of:

A) generating calibrated radiation from at least one first LED-based light source and at least one second LED-based light source based, at least in part, on at least one first calibration value derived from a first light output of the at least one first LED-based light source and at least one second calibration value derived from a second light output of the at least one second LED-based light source, wherein the at least one first LED-based light source and the at least one second LED-based light source are associated at least with the at least one object so as to reduce an ability to recognize or identify the at least one object.

2. The method of claim 1, wherein the act A) comprises an act of:

generating patterns of calibrated radiation from the at least one first and second LED-based light sources so as to cause a confused image of the at least one object.

3. The method of claim 1, wherein the act A) comprises an act of:

A1) generating multi-colored visible calibrated radiation from the at least one first and second LED-based light sources so as to cause the at least one object to significantly blend with the at least one object's surroundings.

4. The method of claim 3, wherein the act A1) comprises an act of:

generating the multi-colored visible calibrated radiation from the at least one first and second LED-based light sources so as to cause the at least one object to significantly simulate the at least one object's surroundings.

5. The method of claim 3, wherein the act A1) comprises an act of:

generating time-varying multi-colored visible calibrated radiation from the at least one first and second LED-based light sources so as to cause the at least one object to significantly blend with the at least one object's surroundings.

6. The method of claim 1, wherein the act A) comprises acts of:

A1) monitoring at least one detectable condition associated with the at least one object; and A2) controlling the at least one first and second LED-based light sources based at least in part on the monitored at least one detectable condition so as to reduce the ability to recognize or identify the at least one object.

7. The method of claim 6, wherein the act A1) comprises an act of:

acquiring information regarding the at least one object's surroundings.

8. The method of claim 7, wherein the act A2) comprises an act of:

A3) controlling the at least one first and second LED-based light sources based at least in part on the acquired information so as to reduce the ability to recognize or identify the at least one object.

9. The method of claim 8, wherein the act A3) comprises an act of:

generating multi-colored visible calibrated radiation from the at least one first and second LED-based light sources so as to cause the at least one object to significantly blend with the at least one object's surroundings.

10. The method of claim 8, wherein the act A3) comprises an act of:

generating multi-colored visible calibrated radiation from the at least one first and second LED-based light sources so as to cause the at least one object to significantly simulate the at least one object's surroundings.

11. The method of claim 8, wherein the act A3) comprises an act of:

generating time-varying multi-colored visible calibrated radiation from the at least one first and second LED-based light sources so as to cause the at least one object to significantly blend with the at least one object's surroundings.

12. An apparatus, comprising:

at least one object; and at least one first LED-based light source and at least one second LED-based light source associated at least with the at least one object and configured to generate calibrated radiation so as to reduce an ability to recognize or identify the at least one object;

wherein the calibrated radiation generated by the at least one first and second LED-based lighting units is based, at least in part, on at least one first calibration value derived from a first light output of the at least one first LED-based light source and at least one second calibration value derived from a second light output of the at least one second LED-based light source.

13. The apparatus of claim 12, wherein the at least one object includes at least one clothing garment.

14. The apparatus of claim 12, wherein the at least one object includes at least one accessory configured to be affixed to a human.

15. The apparatus of claim 12, wherein the at least one first and second LED-based light sources are configured to generate patterns of calibrated radiation so as to cause a confused image of the at least one object.

16. The apparatus of claim 12, wherein the at least one first and second LED-based light sources are configured to generate multi-colored visible calibrated radiation so as to cause the at least one object to significantly blend with the at least one object's surroundings.

17. The apparatus of claim 16, wherein the at least one first and second LED-based light sources are configured to generate the multi-colored visible calibrated radiation so as to cause the at least one object to significantly simulate the at least one object's surroundings.

18. The apparatus of claim 16, wherein the at least one first and second LED-based light sources are configured to generate time-varying multi-colored visible calibrated radiation so as to cause the at least one object to significantly blend with the at least one object's surroundings.

19. The apparatus of claim 12, further comprising at least one sensor to monitor at least one detectable condition associated with the at least one object, wherein the apparatus is configured to control the at least one first and second LED-based light sources based at least in part on the monitored at least one detectable condition so as to reduce the ability to recognize or identify the at least one object.

20. The apparatus of claim 19, wherein the at least one sensor includes at least one image capture system.

21. The apparatus of claim 19, wherein the at least one sensor is configured to acquire information regarding the at least one object's surroundings.

22. The apparatus of claim 21, wherein the apparatus is configured to control the at least one first and second LED-based light sources based at least in part on the acquired information so as to reduce the ability to recognize or identify the at least one object.

23. The apparatus of claim 22, wherein the apparatus is configured to control the at least one first and second LED-based light sources to generate multi-colored visible calibrated radiation based on the acquired information so as to cause the at least one object to significantly blend with the least one object's surroundings.

24. The apparatus of claim 22, wherein the apparatus is configured to control the at least one first and second LED-based light sources to generate multi-colored visible calibrated radiation based on the acquired information so as to cause the at least one object to significantly simulate the least one object's surroundings.

25. The apparatus of claim 22, wherein the apparatus is configured to control the at least one first and second LED-based light sources to generate time-varying multi-colored visible calibrated radiation based on the acquired information so as to cause the at least one object to significantly simulate the least one object's surroundings.

26. A lighting system for camouflaging, comprising:

at least one object;

a first addressable lighting unit including at least one first LED-based light source associated with the at least one object;

at least one second addressable lighting unit including at least one second LED-based light source associated with the at least one object;

at least one sensor configured to monitor at least one detectable condition associated with the at least one object; and at least one controller coupled to the first addressable lighting unit, the at least one second addressable lighting unit, and the at least one sensor, the at least one controller configured to process information acquired by the at least one sensor regarding the at least one detectable condition associated with the at least one object and to dynamically control the first addressable lighting unit and the at least one second addressable lighting unit via addressed data so as to generate calibrated radiation having at least one characteristic that facilitates camouflaging the at least one object;

wherein the calibrated radiation generated by the first addressable lighting unit and the at least one second addressable lighting unit is based, at least in part, on at least one first calibration value derived from a first light output of the first addressable lighting unit and at least one second calibration value derived from a second light output of the at least one second addressable lighting unit.

27. The system of claim 26, wherein the lighting system is configured to generate patterns of calibrated radiation so as to cause a confused image of the at least one object.

28. The system of claim 26, wherein the lighting system is configured to generate multi-colored visible calibrated radiation so as to cause the at least one object to significantly blend with the at least one object's surroundings.

29. The system of claim 26, wherein the lighting system is configured to generate multi-colored visible calibrated radiation so as to cause the at least one object to significantly simulate the at least one object's surroundings.

30. The system of claim 26, wherein the lighting system is configured to generate time-varying multi-colored visible calibrated radiation so as to cause the at least one object to significantly blend with the at least one object's surroundings.

31. The system of claim 26, wherein the at least one object includes a military vehicle.

32. The system of claim 26, wherein the at least one object includes a commercial vehicle.

33. The method of claim 1, further comprising sensing at least one detectable condition associated with the at least one first and second LED-based light sources, and wherein the act A) comprises generating the calibrated radiation based at least in part on the at least one detectable condition.

34. The apparatus of claim 12, wherein the at least one object includes at least one aircraft.

35. The apparatus of claim 12, wherein the at least one object includes at least one water craft.

36. The apparatus of claim 12, wherein the at least one object includes at least one land-based vehicle.

37. The apparatus of claim 12, further comprising a sensor configured to detect at least one detectable condition associated with the at least one first and second LED-based light sources, wherein the calibrated radiation is generated based at least in part on the at least one detectable condition.

38. The system of claim 26, further comprising at least one further sensor configured to detect at least one detectable condition associated with at least the first addressable lighting unit and the at least one second addressable lighting unit; wherein the calibrated radiation is generated based at least in part on the at least one detectable condition.

39. The system of claim 26, wherein the at least one object includes an aircraft.

40. The system of claim 39, wherein the lighting system is disposed at least in proximity to at least one wing of the aircraft.

* * * * *